US007690652B2

(12) United States Patent
Shimizu

(10) Patent No.: US 7,690,652 B2
(45) Date of Patent: Apr. 6, 2010

(54) IMAGE FORMATION DEVICE AND PAPER FEED MECHANISM

(75) Inventor: Noriyuki Shimizu, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 179 days.

(21) Appl. No.: 11/782,975

(22) Filed: Jul. 25, 2007

(65) Prior Publication Data

US 2008/0025768 A1 Jan. 31, 2008

(30) Foreign Application Priority Data

Jul. 31, 2006 (JP) ..... 2006-207746

(51) Int. Cl.
*B65H 5/02* (2006.01)
*B65H 5/04* (2006.01)

(52) U.S. Cl. ..... 271/274; 271/273

(58) Field of Classification Search ..... 271/272, 271/273, 274
See application file for complete search history.

(56) References Cited

U.S. PATENT DOCUMENTS 7,213,986 B2 * 5/2007 Watanabe et al. ..... 400/55

FOREIGN PATENT DOCUMENTS

| | | | |
|---|---|---|---|
| EP | 1 527 889 | A1 | 5/2005 |
| JP | 61-127545 | A | 6/1986 |
| JP | 63-196436 | A | 8/1988 |
| JP | 63-272733 | A | 11/1988 |
| JP | 08-030137 | A | 2/1996 |
| JP | 2005-132537 | A | 5/2005 |
| JP | 2005-324402 | A | 11/2005 |
| JP | 2006-008289 | A | 1/2006 |
| JP | 2006-103864 | A | 4/2006 |

* cited by examiner

*Primary Examiner*—Kaitlin S Joerger
(74) *Attorney, Agent, or Firm*—Global IP Counselors, LLP

(57) ABSTRACT

An image formation device includes an image formation unit and a paper feed mechanism. The image formation unit is configured to print an image on a recording paper. The paper feed mechanism includes a feed roller, a press roller, cylindrical press rings and press roller bearings. The feed roller is configured to impart conveyance force to the recording paper. The feed roller has grip portions being configured to contact the recording paper. The press roller is disposed across from the feed roller. The press roller is configured to press the recording paper against the feed roller. A paper feed path through which the recording paper is fed to the image formation unit is formed between the feed roller and the press roller. The cylindrical press rings are attached to the press roller at locations adjacent to ends of the press roller. The press roller bearings support the press roller and bias the press roller toward the feed roller via the press rings.

16 Claims, 2 Drawing Sheets

IMAGE FORMATION DEVICE AND PAPER FEED MECHANISM

CROSS-REFERENCE TO RELATED APPLICATIONS

This application claims priority to Japanese Patent Application No. 2006-207746 filed on Jul. 31, 2006. The entire disclosure of Japanese Patent Application No. 2006-207746 is hereby incorporated herein by reference.

BACKGROUND OF THE INVENTION

1. Field of the Invention

The present invention generally relates to an image formation device. More specifically, the present invention relates to an image formation device having a paper feed mechanism.

2. Background Information

A conventional image formation device includes an image formation unit and a paper feed mechanism. The image formation unit has a thermal head. With the conventional image formation device, an ink ribbon coated with a sublimation dye is laid over recording paper (printer paper). Electrical energy corresponding to image information is applied to the thermal head. Thermal energy generated by the thermal head sublimates the sublimation dye coating of the ink ribbon and transfers the sublimation dye onto the recording paper to perform specific printing, such as color printing. With the conventional image formation device, rendering of images having gradation is performed by controlling amounts of current sent to the thermal head, that is, amounts of heat generated by the thermal head.

The paper feed mechanism includes a feed roller and a press roller. The feed roller is rotationally driven. The press roller follows the feed roller. The paper feed mechanism is used to securely send the recording paper to the image formation unit a number of times (for example, three or four times). The feed roller and the press roller are usually constituted by a metal shaft. In particular, when the surface of the feed roller is made of metal, grip portions are formed on the feed roller by knurling (texturing in a reticulated pattern) so that the recording paper will be fed more reliably. The grip portions protrude beyond the other surface of the feed roller. The grip portions are prevented from touching the press roller. Also, a paper feed path, which is a gap through which the recording paper passes, is ensured between the feed roller and the press roller.

With another conventional image formation device, a gap ensuring member is further provided at a location a specific distance away from ends of the press roller to ensure the paper feed path (see Japanese Laid-Open Patent Application No. 2006-103864, for example). The gap ensuring member includes a gap roll. The press roller is biased toward the feed roller by a spring or other such biasing member.

With the conventional image formation device, biasing force of the biasing member bends the press roller at both ends toward the feed roller with the gap ensuring member as the fulcrum. As a result, a middle of the press roller bends away from the feed roller, which widens the gap between the press roller and the feed roller. Therefore, the press roller does not sufficiently press the recording paper against the feed roller. Also, the recording paper is not conveyed reliably.

With another conventional image formation device, the press roller further includes a middle portion and end portions to convey the recording paper reliably (see Japanese Laid-Open Patent Application No. 2005-324402, for example).

The middle portion has a smaller diameter than the end portions. The end portions are integrally formed at both ends of the middle portion.

With the conventional image formation device, the middle portion is formed by cutting. Since the middle portion is considerably longer than the end portions, the cutting takes a long time. Also, a sliding material composed of a synthetic resin, for example, must be interposed between the press roller and a biasing member so that the press roller may follow smoothly. As a result, the number of parts and the cost of the image formation device are increased.

Another conventional image formation device further includes thermal roller bearings and press roller bearings to convey the recording paper reliably (see Japanese Laid-Open Patent Application No. H8-30137, for example). The thermal roller bearings are coaxially disposed at ends of a thermal roller and support the thermal roller at both ends of the thermal roller. The thermal roller bearings have a conical shape. A smaller diameter end of each of the thermal roller bearings is contiguous with the thermal roller. The press roller bearings are coaxially disposed at ends of a press roller and support the press roller at both ends of the press roller. The press roller bearings have a conical shape. A larger diameter end of each of the press roller bearings faces the press roller. Outer peripheral faces of the thermal roller bearings are pressed against outer peripheral faces of the press roller bearings to limit a gap between the thermal roller and the press roller.

With the conventional image formation device, the roller bearings have a complicated structure. Therefore, the number of parts and the number of assembly time are increased. As a result, the cost of the image formation device is increased.

In view of the above, it will be apparent to those skilled in the art from this disclosure that there exists a need for an improved image formation device. This invention addresses this need in the art as well as other needs, which will become apparent to those skilled in the art from this disclosure.

SUMMARY OF THE INVENTION

The present invention was conceived in light of the above problems. It is one object of the present invention to provide an image formation device which requires fewer parts and allows recording paper to be fed reliably.

An image formation device includes an image formation unit and a paper feed mechanism. The image formation unit is configured to print an image on a recording paper. The paper feed mechanism includes a feed roller, a press roller, cylindrical press rings and press roller bearings. The feed roller is configured to impart conveyance force to the recording paper. The feed roller has grip portions being configured to contact the recording paper. The press roller is disposed across from the feed roller. The press roller is configured to press the recording paper against the feed roller. A paper feed path through which the recording paper is fed to the image formation unit is formed between the feed roller and the press roller. The cylindrical press rings are attached to the press roller at locations adjacent to ends of the press roller. The press roller bearings support the press roller and bias the press roller toward the feed roller via the press rings.

With the image formation device, it is possible to provide an image formation device which requires fewer parts and allows recording paper to be fed reliably.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
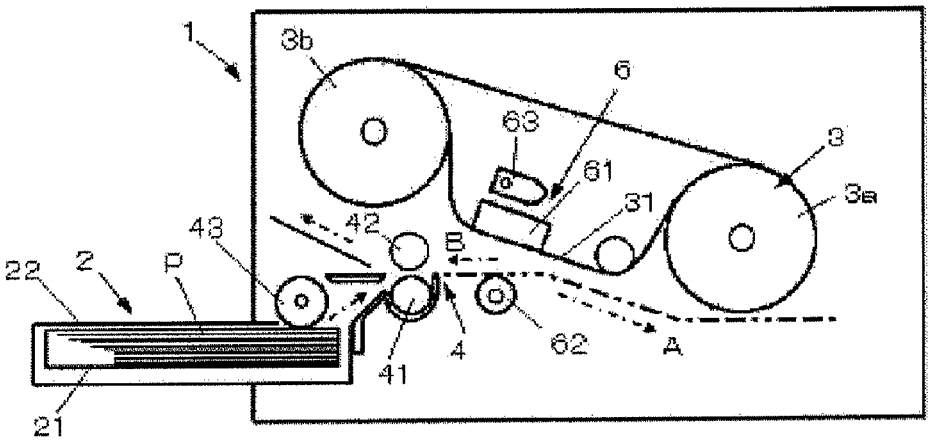
FIG. 1 is a schematic diagram illustrating main components of an image formation device pertaining to an embodiment of the present invention.

A preferred embodiment of the present invention will now be explained with reference to the drawings. It will be apparent to those skilled in the art from this disclosure that the following description of the preferred embodiment of the present invention is provided for illustration only and not for the purpose of limiting the invention as defined by the appended claims and their equivalents.

Referring to FIGS. 1 to 4, an image formation device 1 is illustrated. The image formation device 1 includes a paper feed cartridge 2, an ink ribbon cartridge 3, an image formation unit 6, a paper conveyance unit 4, a chassis 5, a drive unit (not shown) and a control unit (not shown). The paper feed cartridge 2 holds recording paper P, such as printer paper. The ink ribbon cartridge 3 holds an ink ribbon 31 with a sublimation dye. The image formation unit 6 sublimates the sublimation dye that coats the ink ribbon 31 and forms an image on the recording paper P. The paper conveyance unit 4 successively conveys the recording paper P to the image formation unit 6. The chassis 5 mounts the image formation unit 6, etc. The drive unit of the image formation device 1 includes a drive motor, such as a stepping motor, and a gear group having a drive gear, an intermediate gear, a cam gear and the like. The control unit of the image formation device 1 performs various control functions.

The recording paper P includes a printer paper base and a receiving layer formed on the printer paper base. The receiving layer is composed of a thermal transfer recording material. The thermal transfer recording material is generally produced by adding lubricants or the like to a polyester resin, polycarbonate resin or the like.

The paper feed cartridge 2 includes a holding member 21 and a lid 22. In the holding member 21, the recording paper P is placed and held. As a paper feed roller 43 of the paper conveyance unit 4 rotates, an upper most sheet of a stack of the recording paper P placed in the holding member 21 is successively sent out in a paper feed direction A (a direction from the left to the right in FIG. 1).

The ink ribbon cartridge 3 includes a supply member 3*a* and a winding member 3*b*. The supply member 3*a* has a supply bobbin (not shown) that is wound with the ink ribbon 31 and rotatably provided. The winding member 3*b* has a winding bobbin (not shown) for winding the ink ribbon 31. The winding member 3*b* is rotatably provided. The ink ribbon 31 includes a substrate made of paper or film, for example, that serves as a base. The substrate is coated with an ink produced by dissolving a sublimation dye in an acetate, polyester solution or the like, and adding a dispersant to create a colloidal solution. As is commonly known, a yellow printing region, magenta printing region, cyan printing region and surface protection layer region (OP layer) are provided to the ink ribbon 31. The yellow printing region, the magenta printing region, the cyan printing region and the surface protection layer region are substantially the same size as the maximum size (width and length) of the individual images being transferred. Identifiers are also provided between the regions.

Figure 2:
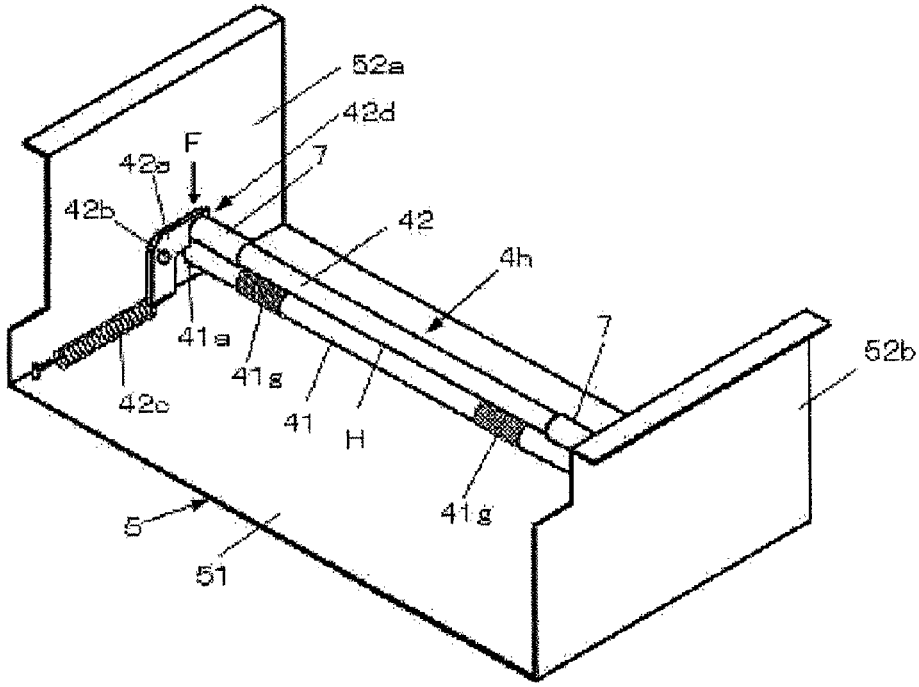
FIG. 2 is an oblique view of the main components of the image formation device shown in FIG. 1.

As shown in FIG. 2, the chassis 5 is formed by bending a steel sheet or the like. The chassis 5 includes a bottom face 51 and first and second side faces 52*a* and 52*b* at both ends of the bottom face 51. The first and second side faces 52*a* and 52*b* rotatably support a pressing mechanism 63 of the image formation unit 6.

The image formation unit 6 includes a thermal head 61, a platen roller 62 and the pressing mechanism 63. The image formation unit 6 is configured to print an image on the recording paper P. The thermal head 61 serves as a printing means. The platen roller 62 is disposed across from the thermal head 61 with the ink ribbon 31 in between. The pressing mechanism 63 presses the thermal head 61 against the platen roller 62 during printing.

The thermal head 61 includes a printing head, a heat radiating plate and a head cover. The heat radiating plate radiates heat away from the printing head and the head cover. The printing head has heat generating elements that are arranged in a line over substantially the same length in the width direction (main scanning direction) as that of the image being printed. The heat generating elements convert electrical energy into thermal energy based on print data. Each of the heat generating elements is supplied with a color signal representing an image that is broken down into three primary colors of yellow (Y), magenta (M) and cyan (C). According to the color signal, the heat generating elements change between a state of generating heat and a state of not generating heat. The sublimation dye on the ink ribbon 31 across from the heat generating elements that are generating heat is sublimated or dissolved and diffused, and transferred to the recording paper P. As a result, an image is formed by recording one line at a time while the recording paper P is moved relative to the thermal head 61 in a printing direction B shown in FIG. 1 (a direction from the right to the left in FIG. 1).

The platen roller 62 is rotatably supported by platen roller bearings (not shown) provided to the first and second side faces 52*a* and 52*b* of the chassis 5 so as to be across from the thermal head 61.

The paper conveyance unit 4 includes a paper feed mechanism 4*h*, the paper feed roller 43 and a conveyance roller (not shown) provided as needed. The paper feed mechanism 4*h* is provided to the paper conveyance unit 4 on an upstream side in the printing direction B and imparts conveyance force to the recording paper P. The paper feed mechanism 4*h* has a feed roller 41, a press roller 42, feed roller bearings 41*a*, press roller bearings 42*a* and a plurality of press rings 7. The feed roller 41 is made of metal and imparts conveyance force to the recording paper P. The press roller 42 is made of metal and is disposed across from the feed roller 41. The press roller 42 presses the recording paper P against the feed roller 41. A paper feed path H that feeds the recording paper P to the image formation unit 6 is formed between the feed roller 41 and the press roller 42. The feed roller bearings 41*a* rotatably support the feed roller 41. The press roller bearings 42*a* rotatably support the press roller 42. The press rings 7 are attached to the press roller 42 at locations adjacent to both ends of the press roller 42.

Referring to FIG. 2, the feed roller 41 is rotationally driven by the drive gear of the drive unit of the image formation device 1. The feed roller bearings 41*a* are supported by bearing support holes (not shown) or the like provided to the first and second side faces 52*a* and 52*b*. Also, as shown in FIGS.

2 to 4, grip portions 41*g* are formed on a surface of the feed roller 41 at substantially symmetric locations in a left and right direction with respect to a center axis C of the paper feed path H. The grip portions 41*g* contact the recording paper P at locations adjacent to left and right edges of the recording paper P and serve as an anti-slip portion. The grip portions 41*g* are formed by rolling (knurling) or the like that form bumps having a specific height. The grip portions 41*g* allow the recording paper P to be conveyed accurately.

The press roller 42 is a metal shaft whose surface is smoothly finished. As shown in FIG. 2, the press roller 42 is rotatably supported by press roller bearings 42*a* via the press rings 7. The press roller 42 rotates so as to follow a rotation of the feed roller 41.

The recording paper P is repeatedly moved back and forth in the lengthwise direction of the recording paper P (that is, in the paper feed direction A and the printing direction B (reverse direction)) by the feed roller 41 and the press roller 42 according to the regions of each of the colors successively transferred. As a result, superposed color printing is carried out by the ink ribbon 31 coated with three colors of sublimation dye. Also, the control unit (not shown) drives the drive unit and controls the system so that during printing, the thermal head 61 is pressed to the platen roller 62 by the pressing mechanism 63. The control unit also controls the system so that during paper feed and discharge, the pressing force of the pressing mechanism 63 is released. Then, the thermal head 61 is retracted as shown in FIG. 1.

The recording paper P conveyed to the image formation unit 6 is first sent to a farthest point downstream in the paper feed direction A. After this, the recording paper P is conveyed from the right to the left in FIG. 1 (that is, in the printing direction B) at substantially the same speed as the ink ribbon 31. In parallel with this, yellow image data is supplied from the control unit (not shown). This results in heat being generated from the heat generating elements of the printing head of the thermal head 61. Then, the sublimation dye in the portion across from the generating elements is transferred (adheres) to the surface of the recording paper P, and a yellow (Y) image is formed on the recording paper P. Once the formation of the yellow image on the surface of the recording paper P is complete, the pressing force of the pressing mechanism 63 to be released. As a result, the thermal head 61 is retracted (lifted) by the spring force of a torsion coil spring (not shown).

After that, the control unit winds up the ink ribbon 31 until a distal end of the magenta printing region of the ink ribbon 31 is detected by an ink ribbon sensor or the like (not shown). The paper conveyance unit 4 is driven to convey the recording paper P in the paper feed direction A until the distal end reaches a proper printing location. This operation makes it possible to form a magenta image on the recording paper P. After that, the above operation is repeated for magenta, cyan and a surface protective layer (colorless and transparent) so as to form a color image, i.e., perform superposed color printing, in an image region on the surface of the recording paper P. The thermal head 61 is raised upward at first (before printing) to form enough of a gap between the thermal head 61 and the platen roller 62 so as not to impede the conveyance of the ink ribbon 31 and the recording paper P.

Once the formation of the color image on the recording paper P is complete, the control unit drives the stepping motor of the drive unit in reverse so that the pressing force of the pressing mechanism 63 on the thermal head 61 is released and the thermal head 61 is raised. Furthermore, the control unit controls the paper conveyance unit 4 so that the recording paper P is discharged from the main part of the apparatus. The recording paper P is conveyed to a discharge portion (not shown) provided near the top of the lid 22 of the paper feed cartridge 2.

Figure 3:
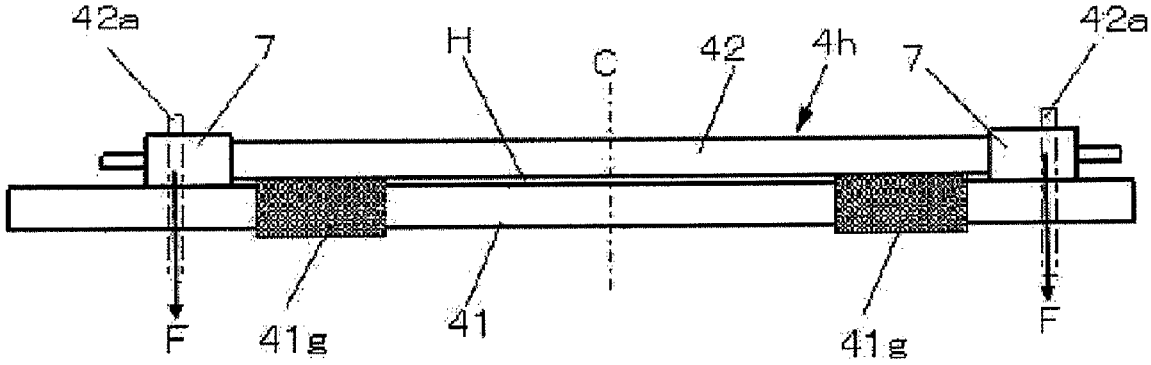
FIG. 3 is a front view of a paper feed mechanism of the image formation device shown in FIG. 1.
Figure 4:
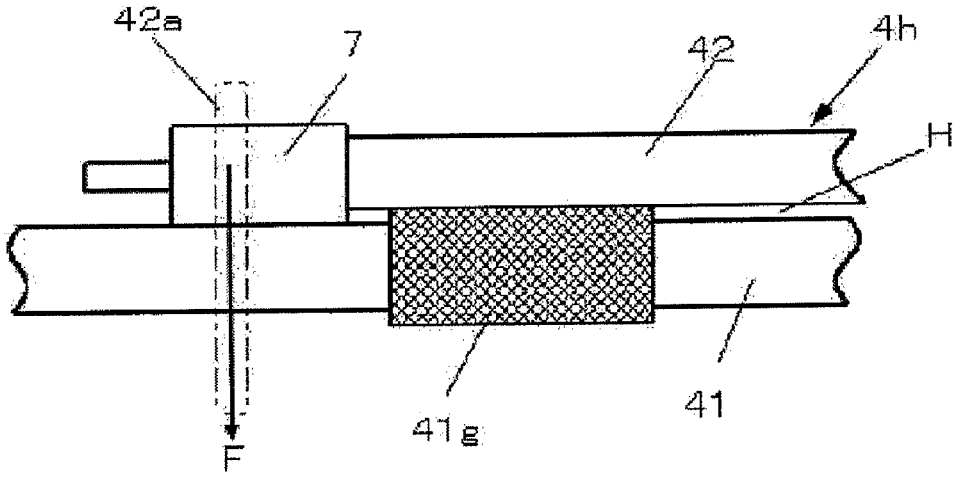
FIG. 4 is a detail view of the paper feed mechanism of FIG. 3.

As shown in FIGS. 2 to 4, the press rings 7 are mounted near both ends of the press roller 42. The press rings 7 have a cylindrical shape. The both ends of the press roller 42 are fixedly inserted to through holes of the press rings 7, respectively. The press rings 7 are made of low density polyethylene (LDPE), high density polyethylene (HDPE), polystyrene (PS), acrylonitrile butadiene styrene (ABS), polycarbonate (PC), polyacetal (POM), or polyvinyl chloride (PVC), or a synthetic resin comprising a mixture of two or more of the above materials, such as ABS and PC. Since the press rings 7 are formed from a synthetic resin, the press rings 7 slide better against the press roller bearings 42*a*. Also, glass fiber-containing synthetic resins obtained by mixing glass fibers into the synthetic resins may be used. In particular, when a polyacetal resin containing glass fiber is used, the abrasion resistance of the press rings 7 is improved and a service life of the press rings 7 is extended.

The cylindrical press rings 7 are supported by the press roller bearings 42*a*. The press roller bearings 42*a* are designed to bias the press roller 42 toward the feed roller 41. The press roller bearings 42*a* are attached to the first and second side faces 52*a* and 52*b*, as shown in FIG. 2.

As shown in FIG. 2, the press roller bearings 42*a* have a hooked shape. A shaft 42*b* passes through corner portions of the press roller bearings 42*a*. The press roller bearings 42*a* are rotatably provided around the shaft 42*b*. At distal ends of the press roller bearings 42*a*, inner peripheral faces 42*d* having a semicircular shape are formed. The press rings 7 are rotatably supported by the inner peripheral faces 42*d*. An outer peripheral face of the press roller 42 contacts the inner peripheral faces of the press rings 7. Springs 42*c* are provided to lower ends of the press roller bearings 42*a*. A biasing force F is exerted on the press roller bearings 42*a* in a direction indicated by the arrows in FIGS. 2 to 4. The biasing force F is applied as a downward force with respect to the press roller 42 (in a direction from the press roller 42 to the feed roller 41) with the shaft 42*b* as its fulcrum. The press roller bearings 42*a* are provided in the same form at both ends of the press roller 42. The press roller bearings 42*a* bias the ends of the press roller 42 toward the feed roller 41.

When the press roller 42 is assembled, the ends of the press roller 42 are latched one after the other to the pair of press roller bearings 42*a*. When one end of the press roller 42 is latched to one of the press roller bearings 42*a*, the biasing force F is exerted on just the one end of the press roller 42. However, since the press rings 7 are disposed where the biasing force F is exerted and the press rings 7 are always in contact with the feed roller 41, the other end of the press roller 42 that has yet to be latched does not lift up. Therefore, assembly of the press roller 42 is carried out smoothly and assembly time is reduced.

The press rings 7 mounted near the ends of the press roller 42 are always contacting the feed roller 41. Furthermore, the press rings 7 are biased by the press roller 42. In other words, in the paper feed mechanism 4*h*, a fulcrum coincides with an effort of the biasing force F. As a result, it is possible to prevent bending of the press roller 42 that occurs when the fulcrum deviates from the effort. Therefore, the gap between the press roller 42 and the feed roller 41 is always kept constant. Thus, the recording paper P is conveyed stably and printing is performed stably.

The cylindrical press rings 7 made of a synthetic resin are mounted near the two ends of the press roller 42. The press roller 42 is biased toward the feed roller 41 by the press roller bearings 42*a* via the press rings 7. Therefore, a structure of the paper feed mechanism 4*h* becomes simple. Also, there is no need for any special cutting to reduce a diameter of a middle portion of the press roller 42 as in the conventional image formation device. Therefore, production time is shortened. Furthermore, since the press rings 7 are made of a synthetic resin, there is no need to interpose a separate sliding material between the press roller 42 and the press roller bearings 42*a* as in the conventional image formation device. Therefore, the number of parts is reduced. As a result, the cost of the image formation device 1 and the paper feed mechanism 4*h* are reduced.

Also, when the press rings 7 are formed from a polyacetal resin containing glass fiber, the press rings 7 have better abrasion resistance, which extends the service life of the press rings 7.

As shown in FIGS. 3 and 4, a diameter of the press roller 42 is reduced at the ends of the press roller 42 in the above embodiment. However, the press roller 42 may have the same diameter all the way to the ends. When the press roller 42 has the same diameter all the way to the ends, there is no need for cutting to form smaller diameter portions at the ends.

The image formation device 1 may be a thermal head type image formation device in which no ink ribbon is used. Instead of the ink ribbon, a thermal recording paper equipped with a thermosensitive coloration layer may be used as a recording paper. The thermal recording paper is heated with a thermal head to color and record an image.

Furthermore, the paper feed mechanism 4*h* may be applied to an inkjet printer or other image formation devices.

GENERAL INTERPRETATION OF TERMS

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image formation device equipped with the present invention. Accordingly, these terms, as utilized to describe the present invention should be interpreted relative to an image formation device equipped with the present invention as used in the normal operating position. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a preferred embodiment has been chosen to illustrate the present invention, it will be apparent to those skilled in the art from this disclosure that various changes and modifications can be made herein without departing from the scope of the invention as defined in the appended claims. Furthermore, the foregoing description of the preferred embodiment according to the present invention is provided for illustration only, and not for the purpose of limiting the invention as defined by the appended claims and their equivalents.

What is claimed is:

1. An image formation device comprising:

an image formation unit configured to print an image on a recording paper; and a paper feed mechanism including a feed roller selectively imparting conveyance force to the recording paper, the feed roller having a pair of grip portions that selectively contacts the recording paper, a press roller disposed across from the feed roller, the press roller selectively pressing the recording paper against the feed roller, a paper feed path through which the recording paper is fed to the image formation unit being formed between the feed roller and the press roller, a pair of cylindrical press rings fixedly coupled to the press roller at locations adjacent to ends of the press roller and directly contacting the feed roller, and a pair of press roller bearings directly supporting the press rings such that the press rings rotate relative to the press roller bearings, respectively, and the press roller bearings biasing the press roller toward the feed roller via the press rings, the press rings being rotatably supported by the press roller bearings, respectively.

2. The image formation device according to claim 1, wherein the grip portions are formed at substantially symmetric locations with respect to a center axis of the paper feed path so as to contact the recording paper at locations adjacent to edges of the recording paper.

3. The image formation device according to claim 2, wherein the press roller is fixedly inserted to the press rings.

4. The image formation device according to claim 3, wherein the press rings are made of synthetic resin.

5. The image formation device according to claim 4, wherein the synthetic resin is a polyacetal resin containing glass fiber.

6. The image formation device according to claim 2, wherein the image formation unit includes a thermal head for printing on the recording paper.

7. The image formation device according to claim 6, wherein the press roller is fixedly inserted to the press rings.

8. The image formation device according to claim 7, wherein the press rings are made of synthetic resin.

9. The image formation device according to claim 8, wherein the synthetic resin is a polyacetal resin containing glass fiber.

10. A paper feed mechanism for feeding a recording paper comprising:

a feed roller selectively imparting conveyance force to the recording paper, the feed roller having a pair of grip portions that selectively contacts the recording paper;

a press roller disposed across from the feed roller, the press roller selectively pressing the recording paper against the feed roller, a paper feed path through which the recording paper is fed being formed between the feed roller and the press roller;

a pair of cylindrical press rings fixedly coupled to the press roller at locations adjacent to ends of the press roller and directly contacting the feed roller; and a pair of press roller bearings directly supporting the press rings such that the press rings rotate relative to the press roller bearings, respectively, and the press roller bearings biasing the press roller toward the feed roller via the press rings, the press rings being rotatably supported by the press roller bearings, respectively.

11. The paper feed mechanism for feeding a recording paper according to claim 10, wherein the grip portions are formed at substantially symmetric locations with respect to a center axis of the paper feed path so as to contact the recording paper at locations adjacent to edges of the recording paper.

12. The paper feed mechanism for feeding a recording paper according to claim 11, wherein the press roller is fixedly inserted to the press rings.

13. The paper feed mechanism for feeding a recording paper according to claim 12, wherein the press rings are made of synthetic resin.

14. The paper feed mechanism for feeding a recording paper according to claim 13, wherein the synthetic resin is a polyacetal resin containing glass fiber.

15. The image formation device according to claim 1, wherein the press rings are formed as separate members from the press roller.

16. The image formation device according to claim 10, wherein the press rings are formed as separate members from the press roller.

* * * * *